US007913337B1

(12) United States Patent
Masson

(10) Patent No.: US 7,913,337 B1
(45) Date of Patent: Mar. 29, 2011

(54) AMBULATORY SURGICAL GURNEY

(76) Inventor: Marcos V. Masson, Houston, TX (US)

( * ) Notice: Subject to any disclaimer, the term of this patent is extended or adjusted under 35 U.S.C. 154(b) by 386 days.

(21) Appl. No.: 12/034,459

(22) Filed: Feb. 20, 2008

Related U.S. Application Data

(63) Continuation-in-part of application No. 11/139,946, filed on May 31, 2005.

(51) Int. Cl.

| | |
|---|---|
| ***A61G 7/015*** | (2006.01) |
| ***A61G 7/005*** | (2006.01) |
| ***A61G 7/008*** | (2006.01) |
| ***A61G 7/018*** | (2006.01) |
| ***A61G 13/10*** | (2006.01) |
| ***A61G 13/12*** | (2006.01) |

(52) U.S. Cl. ..... 5/618; 5/608; 5/942; 5/621; 5/503.1; 5/658

(58) Field of Classification Search ..... 5/616–618, 5/613, 942, 611, 11, 610, 86.1, 600, 601, 5/621–624, 503.1, 507.1, 658, 663, 607, 5/608

See application file for complete search history.

(56) References Cited

U.S. PATENT DOCUMENTS

| | | | | |
|---|---|---|---|---|
| 401,681 | A | 4/1889 | Brown | |
| 503,969 | A | 8/1893 | Huddleston | |
| 2,101,290 | A | 12/1936 | Pierson | |
| 2,377,649 | A | 6/1945 | Quinney | |
| 3,304,116 | A * | 2/1967 | Stryker | 296/20 |
| 2,609,862 | A | 5/1971 | Pratt | |
| 3,579,671 | A | 5/1971 | Koetter | |
| 3,739,406 | A | 6/1973 | Koetter | |
| 3,858,578 | A * | 1/1975 | Milo | 600/229 |
| 4,084,274 | A | 4/1978 | Willis et al. | |
| 4,182,322 | A * | 1/1980 | Miller | 5/637 |
| 4,579,324 | A | 4/1986 | McConnell | |
| 4,584,989 | A * | 4/1986 | Stith | 600/18 |
| 4,658,450 | A | 4/1987 | Thompson | |
| 4,679,263 | A * | 7/1987 | Honer | 5/640 |
| 4,730,609 | A | 3/1988 | McConnell | |
| 4,772,002 | A * | 9/1988 | McConnell et al. | 5/623 |
| 4,858,260 | A * | 8/1989 | Failor et al. | 5/618 |
| 4,912,787 | A * | 4/1990 | Bradcovich | 5/601 |
| 4,939,801 | A | 7/1990 | Schaal et al. | |
| 5,111,541 | A | 5/1992 | Wagner | |
| 5,275,176 | A | 1/1994 | Chandler | |
| 5,419,756 | A | 5/1995 | McConnell | |
| 5,513,827 | A * | 5/1996 | Michelson | 248/279.1 |
| 5,662,300 | A | 9/1997 | Michelson | |
| 5,775,334 | A | 7/1998 | Lamb et al. | |
| 5,899,425 | A * | 5/1999 | Corey, Jr. et al. | 248/276.1 |
| 5,926,876 | A | 7/1999 | Haigh et al. | |
| 5,957,135 | A | 9/1999 | Molina | |
| 6,186,900 | B1 | 2/2001 | Rathnakar | |
| 6,289,537 | B1 | 9/2001 | Hopper et al. | |

(Continued)

*Primary Examiner* — Robert G Santos
(74) *Attorney, Agent, or Firm* — Egbert Law Offices PLLC

(57) ABSTRACT

An ambulatory surgical gurney has a base, a frame positioned above the base, and a lifting mechanism positioned between the base and the frame. The frame has a sections pivotally connected together. The lifting mechanism has a first ram extending vertically between the base and the frame, a second ram extending vertically between the base and the frame, a lift arm pivotally connected to the frame, and a controller that controls the movement of the first and second rams and the lift arm. The upper end of the first ram and the upper end of the second ram are pivotally connected to the frame. An anaconda is attached to the frame. The anaconda has segments connected end-to-end and a ratchet spool.

13 Claims, 6 Drawing Sheets

U.S. PATENT DOCUMENTS

| | | | | |
|---|---|---|---|---|
| 6,351,678 | B1 * | 2/2002 | Borders | 700/83 |
| 6,564,406 | B2 | 5/2003 | VanSteenburg et al. | |
| 6,607,245 | B1 * | 8/2003 | Scher | 297/393 |
| 6,698,044 | B2 * | 3/2004 | Greenfield et al. | 5/624 |
| 6,804,846 | B2 | 10/2004 | Schuerch | |
| 6,880,432 | B2 | 4/2005 | Hsieh | |
| 7,730,565 | B1 * | 6/2010 | Masson | 5/646 |
| 2003/0182726 | A1 * | 10/2003 | Greenfield et al. | 5/648 |

* cited by examiner

AMBULATORY SURGICAL GURNEY

CROSS-REFERENCE TO RELATED APPLICATIONS

The present invention is a continuation-in-part of U.S. application Ser. No. 11/139,946, filed on May 31, 2005, and entitled "GURNEY FOR USE IN ARTHROSCOPIC SURGERY", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to gurneys that can be used as operating room tables in a hospital environment. Additionally, the present invention relates to gurneys that can be used as a wheelchair. More particularly, the present invention the relates to gurneys that are adaptable for use as a patient support in the operating room in the field of arthroscopic surgery. More particularly still, the present invention relates to gurneys that have electromechanical mechanisms for manipulating the positions of the bed. More particularly still, the present invention the relates to hospital beds that have various accessories.

2. Description of Related Art Including Information Disclosed Under 37 CFR 1.97 and 37 CFR 1.98.

Gurneys are often used in the hospital environment for patient support and transport. In particular, when a patient is taken to the operating room, the patient is placed upon a gurney and wheeled into the operating room. Once in the operating room, the patient is transferred from the gurney onto the surgical table so that the patient is in a proper position for surgery. The gurney is then removed from the operating room, or placed elsewhere, during the surgical procedure. Subsequent to surgery, the gurney is then returned to the operating room, the patient is placed upon the gurney, and then the patient is wheeled to other locations. The patient is also transferred from the gurney to a wheelchair when the patient leaves the hospital.

Unfortunately, the continual transfer of the patient from the gurney to the surgical table and from the gurney to the wheelchair, is inconvenient, time-consuming, tiresome and potentially injurious. Nurses, and other hospital personnel, often experience back pain, and other assorted injuries, during the transfer of the patient. Often, the patient must be physically lifted from the surgical table and placed upon the gurney and vice-versa. In other circumstances, the improper movement of the patient can adversely affect the surgical procedure or the results achieved from the surgery. As such, a need has developed whereby the gurney is actually used as the operating table and the wheelchair.

During the surgical procedures, the surgeon's instruments are often in a very inconvenient location. In certain circumstances, the surgeon must drape the cords associated with the instruments over the patient or route the chords through inconvenient arrangements. Cord management is a continual problem for the surgeon during any surgical procedure. In certain circumstances, the improper routing and location of the cords can cause an improper operation of the instrument or restrict the surgeon from his or her desired use of the instrument. As such, a need has developed so as to provide instrument holders for surgeons during arthroscopic surgery.

In the performance of orthopedic surgery and related procedures, it is often necessary to support a patient's body, including one or more limbs, in a fixed position during the procedure, and also to vary the position from time to time. Often times, it is desirable to maintain such a limb, for example, in a fixed position during the surgical procedure so as to keep the procedure area as clear as possible and avoid the limb interference. In some cases, operating room personnel manually support the particular extremity. For example, the assistant may have to stand on a platform in order to manually hold the correct angle while the surgeon carries out the operation.

Such use of operating room personnel to manually support a patient's extremities during a surgical procedure is undesirable in that the assistant becomes tired over time and finds it necessary to change positions at a critical or otherwise inconvenient times. This may lead, for example, to actual trauma to the structures of the body. Furthermore, the assistant is unable to observe crucial aspects of the operation itself. Moreover, in addition to possibly interfering with the light available to the surgeon, the height of the assistant may increase the chances of contamination of the operating field.

It is well known and appreciated that in surgical procedures, time is of the essence, and delays associated with adjustment of support equipment are unwanted. Additionally, during certain procedures, it is desirable to impose or to change a biasing force on a body portion or limb which is undergoing a surgical procedure or treatment. In view of the aforementioned shortcomings associated with conventional surgical techniques for supporting a patient's body during surgery, there is a strong need in the art for a surgical support apparatus in which the apparatus may be mounted onto an operating table or be otherwise relatively secured and positioned outside the sterile field in a way which affords for a quick and easy positioning and repositioning of the patient's body part.

In the past, various patents have issued related to gurneys as used for patient transport. For example, U.S. Pat. No. 4,939,801, issued on Jun. 10, 1990 to Scale et al., teaches a patient transporting and turning gurney for receiving and lifting a patient from a hospital bed, for transporting and depositing the patient onto the hospital operating table, and for lifting and turning a patient for surgery. The gurney has a U-shaped base. This base is of sufficiently small dimension to fit under a hospital bed and of sufficiently large dimension to straddle the sides of the conventional operating table pedestal. The gurney further includes an overlying stretcher support for supporting a rotatable stretcher frame. A longitudinally extending rotating stretcher frame is mounted for rotation about its longitudinal axis on the stretcher support. There is provided a lifting device for moving the stretcher support upwardly and downwardly relative to the base.

U.S. Pat. No. 5,111,541, issued on May 12, 1992 to K. E. Wagner, describes anon-metallic gurney for patient transport. This gurney is formed of materials that are non-metallic, non-magnetic and of low electrical conductivity. This gurney is particularly used for modern non-invasive body scanning equipment.

U.S. Pat. No. 6,289,537, issued on Sep. 18, 2001 to Hopper et al., describes a patient support having a frame supporting a patient supporting surface as well as a pair of foot rest mechanisms thereon. The pair of foot rest mechanisms are each selectively movable from a stowed position beneath the patient supporting surface to a deployed position. A drop-leaf foot section forms a part of the patient supporting surface. The drop-leaf foot section is movable to a vertically upright position so as to expose a space between the two foot rest mechanisms.

Additionally, in the past, various patents have issued relating to extremity positioners. For example, U.S. Pat. No. 4,579,324, issued on Apr. 1, 1986 to B. E. McConnell, describes a positioning apparatus for use in surgical operating procedures. This positioning apparatus includes one or more generally vertically extending support arms which are connected at their lower ends to universal positioner mechanisms. These mechanisms may be adjustably positioned along a support bar suspended from and substantially rigidly connected to the operating table. The positioning mechanisms include a ball-and-socket coupling including a spaced-apart support block having socket portions for forcibly engaging the block under the urging of a plurality of springs. A lever-actuated cam connects to a foot pedal to operably release the biasing force on the support blocks, whereby the position of the support arm connected at one end to the ball may be finely adjusted over a wide range of positions. U.S. Pat. No. 4,702,465 is continuation-in-part of U.S. Pat. No. 4,579,324.

U.S. Pat. No. 4,730,609, issued on Mar. 15, 1988 to B. E. McConnell, describes a surgical drape having limb-securing structures. A boot of conformable impervious material is attached to the surgical drape for receiving the patient's limb. The boot has a tubular sidewall defining a pocket which is joined in registration with the opening of the drape.

U.S. Pat. No. 5,419,756, issued on May 30, 1995 to B. E. McConnell, describes an arm traction device. This arm traction device has a traction bar in combination with a hand wrap, or hand-and-arm wraps, for suspending and orienting a patient's hand and arm in a substantially elevated position during a surgical procedure. The hand wrap is attached about the patient's closed fist and the traction bar is bendable. The traction bar includes hook-and-loop material so that the traction bar may be conformed to the hand and attach itself securely in place to the top and opposing side surfaces of the hand-wrapped fist so that rotational or traction forces may be applied to the hand and arm.

U.S. Pat. No. 5,775,334, issued on Jul. 7, 1998 to Lamb et al., describes a limb positioning apparatus for surgery. This limb positioning apparatus has a structural member with a compartment having an opening thereto. This structural member is supported at a predetermined position relative to the limb and at a certain distance from the limb. A first line is linked or attached to the limb and connected to a constant force spring located within the compartment of the structural member. A second line is attached to the limb and is also connected to a constant force spring lying within the compartment of the structural member. The forces exerted by the first and second constant force springs are applied cumulatively or alternately to provide a pre-determined tension force on the limb of the patient thereby positioning the limp appropriately.

U.S. Pat. No. 5,957,135, issued on Sep. 28, 1999 to J. E. Molina, describes an arm holder for transillary first rib resection. This apparatus includes a support assembly, such as a sling, for supporting the limb during the surgical procedure, and a mounting assembly slidably coupled to the support assembly by at least one slide rod. The support assembly is vertically positionable relative to the mounting assembly.

U.S. Pat. No. 5,275,176, issued on Jan. 4, 1994 to Chandler, describes a surgical operating table particularly adapted for shoulder arthroscopy. The table includes a central seat support, a leg support, and a back support modified to include detachable modular shoulder cut-out to gain access to the posterior aspect of the shoulder. The leg support and back support are hingedly connected to the seat support for positioning the patient in a seating posture by operating mechanical crank arms. The patient is first supported in a supine position, anaesthetized, secured to the table, and the table is thereafter configured to a sitting position. One of the modular shoulder cut-outs is then removed to provide access to the shoulder on which arthroscopy is to be performed.

U.S. Pat. No. 3,739,406, issued on Jun. 19, 1973 to Koetter, discloses an adjustable bed particularly for use in hospitals and nursing homes for which a chassis is provided with at least one telescopically expandable pan, abed frame tiltable relative to the chassis, at least one lifting assembly being disposed on the chassis, and at least one foot for each extendable part of the span. The bed frame has a middle portion and two end portions hinged to the middle portion. At least one lifting assembly is disposed at each end of the middle portion of the bed frame for adjusting the bed frame to various elevated and inclined positions.

U.S. Pat. No. 6,804,846B2, issued on Oct. 19, 2004 to Schuerch, discloses an adjustable position shoulder arthroscopy chair for surgical operating tables consisting of a back supporting platform pivotally attachable to the end of the table and an externally powered position actuator mounted at the base of the platform nearest the table and pivotally mounted to the platform at a location spaced apart from the base. The actuator is extendable and retractable and may be powered either electrically, hydraulically, or by compressed air. The extension and retraction of the actuator is controlled by a suitable device within the actuator or remote from it.

U.S. Pat. No. 6,564,406B2, issued on May 20, 2003 to VanSteenburg et al., discloses a surgical table that has an articulated leg section with accessory attachment rails on opposite sides thereof. A shoulder surgery attachment for the surgical table includes a chair back assembly having a base on one end thereof and a cooperating second connector at each of its sides. Each second connector is releasably attachable to its corresponding first connector. A pair of mounting blades are provided on opposite sides of the base. A rail clamp is positionable along the attachment rails to be fastened to each of the attachment rails to provide a first connector at each side of the leg section.

U.S. Pat. No. 5,926,876, issued on Jul. 27, 1999 to Haigh et al., discloses a device for adapting a surgical operating table such that the upper torso of the patient can be raised in order to place the patient in a seated position, the device further providing the means of exposing or supporting a side of said patient's upper torso and limbs. The device contains a continuously adjustable positioning mechanism, and corresponding actuator for said mechanism, in a way that a user can rapidly and conveniently put a patient in the desired position, from a supine posture to a fully seated position. Additionally, the device does not render the surgical table permanently modified, as the process of modification is reversible by means of a simple attachment mechanism. The device uses a back support section hingedly connected to a base frame, this base frame providing the attachment support to the surgical table. Side support panels are either moved out of the way on the patient's operative side, or left in place to provide support to the unaffected side. Two embodiments are described that differ solely in the way the back support surface is implemented.

U.S. Pat. No. 4,658,450, issued on Apr. 21, 1987 to Thompson, discloses a multi-position bed such as is used in hospitals. The bed has a base frame supported on casters and having a pair of pivoted angled lifting arms. One lifting arm is pivoted in turn to an interlink pivoted to a pivot bracket. Another lifting arm is pivoted directly to a second pivot. Pivot brackets act as the pivot supports for the center section of a mattress platform which also comprises two side sections. The side sections are not hinged directly to the center section but simply have interengaging features in the form of side frame registers. When the bed is used as a turning bed the interengaging features disengage. The side sections are carried by pairs of links which join the pivot brackets to the side sections at points underneath the side sections. These side sections are also connected by side frame pivot arms to an end pivot frame at each end of the bed. The pivot frame is rigidly connected to the center bed section. The movement of the bottom links is restricted in a downward direction by bottom link stops. The links may be disconnected and the side sections connected rigidly to the center section so that the mattress platform can be caused to tilt bodily in a lateral sense.

U.S. Pat. No. 4,084,274, issued on Apr. 18, 1978 to Willis et al., discloses a turning bed which can be tilted mechanically to turn the occupant from side to side, comprising a tilting assembly pivotally secured to a bed frame of known type. The tilting assembly consists of a mattress frame longitudinally divided into at least three parts: a center section with an outer section(s) pivotally connected adjacent each longitudinal side of the center section. The pivotal connection is such that when the center section is tilted, the outer section(s) adjacent the raised side of the center section is/are tilted as one with the center section, and the outer section(s) adjacent the other side of the center section pivot(s) relative thereto. The center section is pivotally supportable from the bed frame, and can be tilted by a lever secured at one end to the center section, the other end of the lever being moveable (by suitable means such as a screw-and-nut arrangement) to tilt the center section.

U.S. Pat. No. 3,579,671, issued on May 25, 1971 to Koetter, discloses an adjustable bed that has a chassis, a bed frame disposed on the chassis, two or three hydraulic cylinder piston units disposed at the ends of the bed, an articulated connection between the cylinder and the piston unit and the bed frame so that the bed frame may be moved to various elevated and/or inclined positions.

U.S. Pat. No. 2,609,862, issued on Sep. 9, 1952 to Pratt, discloses a hospital chair with a base, a frame having three section, and a mechanical lifter that adjusts the height of the chair up and down. The sections of the chair fold up and down to change the chair position to a flat position. The height and positions of the sections are adjusted manually.

U.S. Pat. No. 2,377,649, issued on Jun. 5, 1945 to Quinney, discloses a convertible chair that converts from a chair position to a bed position. Various mechanical ratchets and spools accomplish the objective of changing positions of the chair. The chair has a frame with three sections. The ends of the frame have legs for supporting the sections on the floor. The position of the convertible chair is adjusted manually.

U.S. Pat. No. 2,101,290, issued on Dec. 18, 1936 to Pierson, discloses an invalid chair with a frame having four sections and a base with wheels. The position of the sections is manually adjusted to change the position of the chair from a chair position to a bed position. The base of the chair is of a fixed height.

U.S. Pat. No. 503,969, issued on Aug. 29, 1893 to Hudleston, discloses a corpse dressing table with a movable head section. The head section moves upward relative to the rest of the table so as to position the torso of a corpse at an angle relative to the legs. The table can be folded upon itself for storage and transporation.

U.S. Pat. No. 5,662,300, issued on Sep. 2, 1997 to Micheldson, discloses a gooseneck instrument holder having an instrument holder tip, a gooseneck, a base and a detachable fiber-optic light cord. The tip, gooseneck, and base are connected by means of a cable which passes through a deflection member in the base. Tension on the cable is adjusted by a detachable handle at the base via a bolt and serves to simultaneously tighten the tip about an instrument, to hold the gooseneck in place, and to hold the base steady so that the holder holds an instrument in place. Very small amounts of turning of the handle is necessary to adequately tighten the holder in place.

U.S. Pat. No. 6,186,900, issued on Feb. 13, 2001 to Rathnakar, discloses a flexible shaft comprising a flexible outer tube containing a shaft core with specially designed links that closely fit within the smooth interior of the outer tube. The links are substantially rectangular and have a construction which limits a flex angle between links. The links may include stop surfaces which limit the flex angle to prevent kinking or to limit longitudinal movement of the links with respect to one another.

U.S. Pat. No. 6,880,432, issued Apr. 19, 2005 to Hsieh, discloses a ratchet socket for fitting onto a screwed member. The ratchet socket is drivable by a tool to wrench the screwed member. The ratchet socket includes a cylindrical main body formed with at least one internal circular hole and at least one through hole formed on the circumference of the main body and communicating with the circular hole, and a ratchet mechanism including a ratchet wheel rotatably disposed in the circular hole, a dog member movably accommodated in the through hole and a resilient hoop fitted around the main body to exert a resilient force onto the outer side of the dog member so as to keep the dog member resiliently engaged with the ratchet wheel.

U.S. Pat. No. 401,681, issued on Apr. 16, 1889 to Brown, discloses a flexible power shaft that has a flexible sleeve made of leather or rubber, a helical wire coil enclosed in the flexible sleeve, and a chain extending in the interior of the helical wire coil. The shaft is made in sections coupled together successively. The two ends of each sections are similar so that the sections can be connected together end to end.

It is another object of the present invention to provide an ambulatory surgical gurney that can be used as an operating room table and a chair.

It is another object of the present invention to provide an ambulatory surgical gurney that is substantially made of plastic.

It is another object of the present invention to provide an ambulatory surgical gurney with electromechanical lifting mechanisms.

It is still another object of the present invention to provide an ambulatory surgical gurney with ends and sides that are independently angularly adjustable.

It is another object of the present invention to provide an ambulatory surgical gurney that is light-weight.

It is another object of the present invention to provide an ambulatory surgical gurney that can accommodate various accessories at the same time.

It is another object of the present invention to provide an ambulatory surgical gurney that minimizes the need to move a patient between gurneys and operating room tables.

It is another object of the present invention to provide an ambulatory surgical gurney that minimizes the need to move a patient between gurneys and wheelchairs.

It is still another object of the present invention to provide an ambulatory surgical gurney that is optimized for arthroscopic surgery.

It is another object of the present invention to provide an ambulatory surgical gurney that can be controllably positioned wirelessly and remotely.

These and other objects and advantages of the present invention will become apparent from a reading of the attached specification and appended claims.

BRIEF SUMMARY OF THE INVENTION

The present invention is an ambulatory surgical gurney comprising a base, a frame positioned above the base, and an electromechanical lifting means positioned between the frame and the base. The frame has a plurality of sections pivotally connected together. The electromechanical lifting means adjusts a distance and an angle of the frame above the base.

The electromechanical lifting means comprises a first ram extending vertically between the base and the frame, a second ram extending vertically between the base and the frame, a lift arm pivotally connected to the frame, and an electronic controlling means for controlling a movement of the first and second rams and for controlling a movement of the lift arm. The first ram is in spaced relationship to the second ram. The frame is connected pivotally to an upper end of the first and second rams. The lift arm is expandable and retractable so as to controllably move the frame from side-to-side.

The base comprises a central portion, a plurality of foot portions extending outwardly from the central portion, and an oxygen-tank holder formed in one of the plurality of foot portions.

The plurality of sections are movable among a first position resembling an operating room table and a second position resembling a chair and a third position resembling a gurney. The plurality of sections comprises a back section, a center section pivotally connected to the back section such that the back section is movable between a first position coplanar with the center section and a second position approximately perpendicular upwardly relative to the center section, a leg section pivotally connected to the center section, and a foot section pivotally connected to the leg section. The center section is pivotally connected to the upper end of the first ram and to the upper end of the second ram and to the lift arm. The foot section is movable between a first position coplanar with the leg section and a second position approximately perpendicular relative to the leg section. The back section comprises a first shoulder portion removable from the back section, a second shoulder portion removable from the back section, and a head portion located between the first portion and the second portion.

The head portion is movable in two dimensions. The head portion has a head holder comprising a forehead strap having ends removably connected to the head portion, a chin strap connected to the forehead strap, and an eye cover connected to the forehead strap.

The electronic controlling means comprises a computer mounted to the base, a plurality of actuators electrically connected to the computer, a wireless controlling means for wirelessly controlling the first and second rams and the lift arm having an LCD screen, and a rechargeable battery electrically connected to the computer and to the plurality of actuators.

The present invention further comprises an IV holder removably attached to the frame, a locker positioned on the base between the first and second rams, a plurality of X-ray cassettes removably positioned in the frame, at least one rail removably mounted to a side of the frame, a plurality of wheels mounted to each of the plurality of foot portions, a brake mechanism for controlling a movement of each of the plurality of wheels from a first position to a second position, and an accessory rail mounted to a side of the frame. The rail is expandable for a length equal to a length of the frame. The accessory rail has a plurality of clamps for mounting accessories thereto.

The ambulatory surgical gurney further comprises a torso holder removably attached to the back section, a leg holder removably attached to the leg section, an arm holder removably attached to the center section, a Mayo stand removably mounted to a back of the back section, a scope holder removably attached to the Mayo stand, and a chart rack mounted to an end of the frame opposite the back section.

The present invention also has an anaconda removably mounted to the frame. The anaconda comprises a plurality of segments connected end-to-end so as to form a flexible tube, and a ratchet spool connected to an end of a first segment of the plurality of segments. Each of the plurality of segments has a body comprising a cylindrical portion having a hollow interior and a top and a bottom, and a rounded member having a hollow interior and a top and a bottom. The bottom of the rounded member is attached to the top of the cylindrical portion. The hollow interiors of the rounded member and the cylindrical portion form a continuous cylindrical channel within the body. The bottom of the cylindrical portion is formed so as to accommodate the top of the rounded member.

The frame and the base and the rail are formed of a polymeric material.

DETAILED DESCRIPTION OF THE INVENTION

Figure 1:
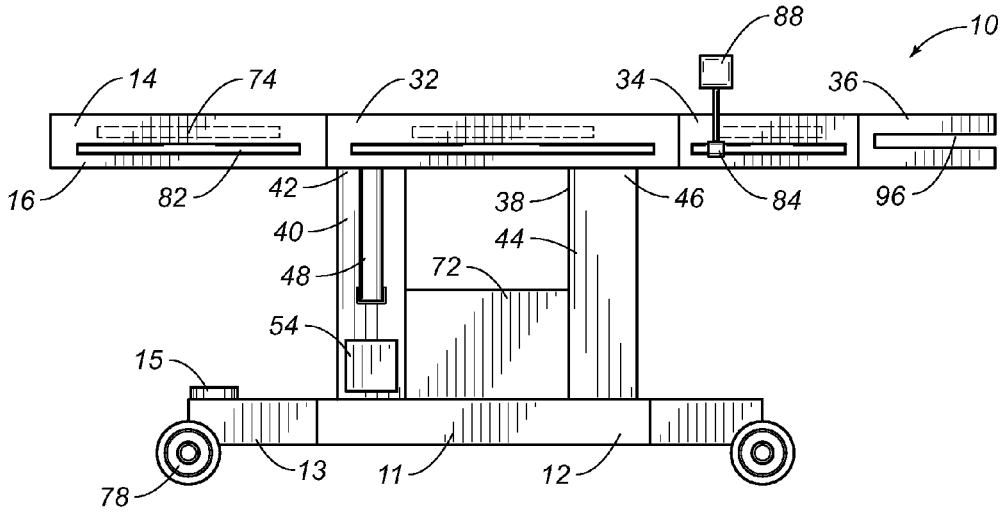
FIG. 1 is a side view of the ambulatory surgical gurney of the present invention with the sections in the operating room table position.

Referring to FIG. 1, there is shown a side view of the ambulatory surgical gurney 10 of the present invention. The ambulatory surgical gurney 10 has a base 12 with a central portion 11, foot portions 13, and an oxygen tank holder 15. The foot portions 13 extend outwardly from the central portion 11. The oxygen tank holder 15 is located on the top end of one of the foot portions 13. Wheels 78 are attached to each of the foot portions 13. The first ram 40 and the second ram 44 extend vertically upwardly from the central portion 11 of the base 12. The locker 72 is positioned between the first ram 40 and the second ram 44. The locker 72 allows the patient to store his or her personal belongings.

The frame 14 of the ambulatory surgical gurney 10 has a plurality of sections. The plurality of sections includes the back section 16, the center section 32, the leg section 34, and the foot section 36. The back section 16 is pivotally connected to the center section 32. The center section 32 is also pivotally connected to the leg section 34. The leg section 34 is also pivotally to the foot section 36. The back section 16, the center section 32, and the leg section 34 have slots 74 for X-ray cassettes. The back section 16 is pivotally connected to the center section 32 so that the back section 16 can be positioned at any angle relative to the center section 32 ranging from horizontal to vertical. Likewise, the leg section 34 can be positioned relative to the center section 32 at any angle ranging from horizontal to vertical. Likewise still, the foot section 36 can be positioned relative to the leg section 34 at any angle from vertical to horizontal.

Referring still to FIG. 1, the plurality of sections are in the operating table position. The upper end 42 of the first ram 40 and the upper end 46 of the second ram 44 are pivotally connected to the center section 32 of the frame 14. A lift arm 48 is mounted on the first ram 40 and pivotally connected to the center section 32. The lift arm 48 expands and retracts so as to move the position and angle of the sections 16, 32, 34, and 36 of the ambulatory surgical gurney 10. The electronic controlling means 54 controls the lift arm 48.

An accessory rail 82 can be seen on each of the back section 16, the center section 32, and the leg section 34. Attached to the accessory rail 82 of the leg section 34 is a clamp 84 with a leg holder 88 extending therefrom. The leg holder 88 can hold the leg of a patient off the surface of the frame 14 without the need for a human assistant. A chart rack holder 96 is formed in the foot section 36. The rack holder 96 can hold patient information and data so that it is easily accessible by medical personnel.

Figure 2:
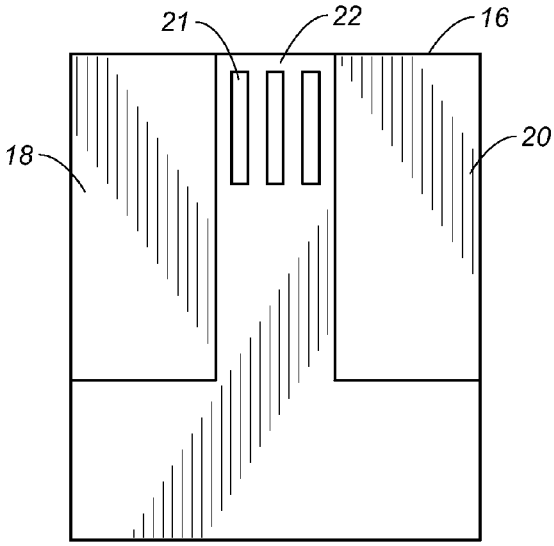
FIG. 2 is a top view of the back section of the ambulatory surgical gurney of the present invention.

Referring to FIG. 2, there is shown a top view of the back section 16. The back section 16 has a first shoulder portion 18, a second shoulder portion 20, and a head portion 22. The head portion 22 has slots 21 where a head holder (not shown) is inserted and movable therein. The first shoulder portion 18 and the second shoulder portion 20 are each removable from the head portion 22 so that a surgeon can access the patient's body from various angles and not have to lean over the table to do so.

Figure 3:
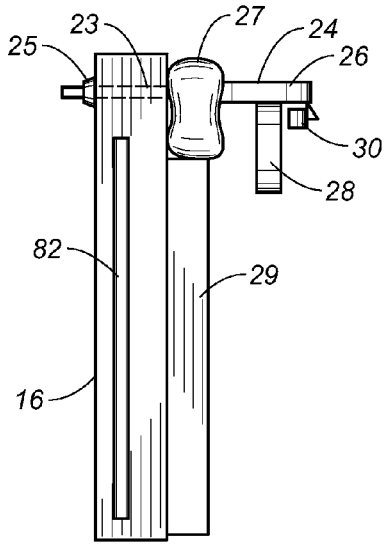
FIG. 3 is a side view of the back section with a head holder attached thereto.

Referring to FIG. 3, there is shown a side view of the back section 16 with the head holder 24 attached thereto. The back section 16 has an accessory rail 82 on a side thereof. The back section 16 also has a head holder 24. The head holder 24 has a forehead strap 26, a chin strap 28, and an eye cover 30. The forehead strap 26 and the chin strap 28 serve to hold a head of a patient close to the back section 16 during arthroscopic surgery. The eye cover 30 serves to protect the eyes of the patient during surgery from any liquids or solids that could possibly damage the eyes of the patient. The head holder 24 also includes a head cushion 27. A rod 23 extends from the head cushion 27 through the slots 21 in the back section 16. A clamp 25 affixes the head holder 24 within the slots 21 of the back section 16 by tightening against the rod 23. Adjacent to the head cushion 37 is a back cushion 29 that runs the length of the back section 16. The patient lies on the head cushion 37 and the back cushion 29.

Figure 4:
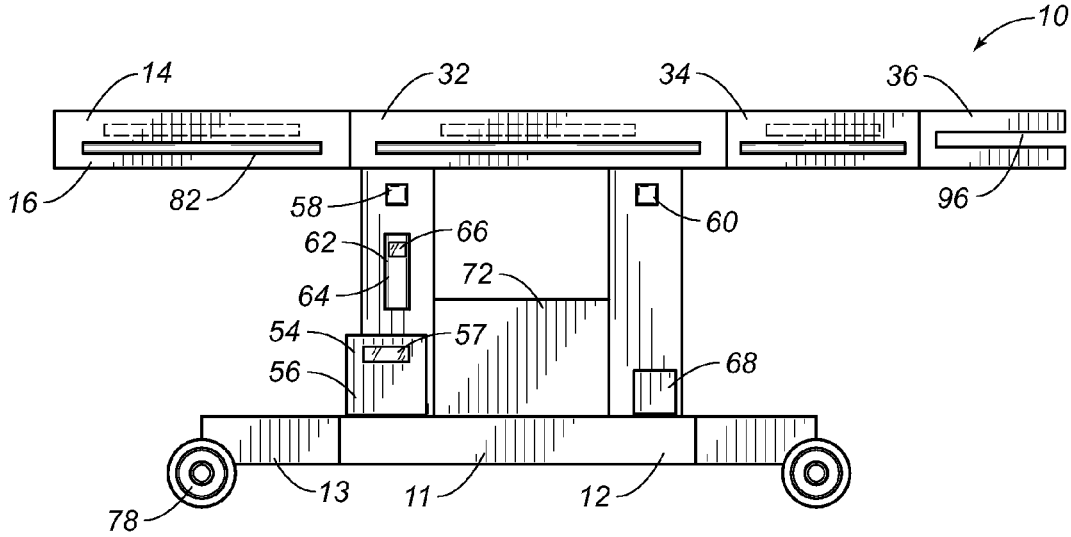
FIG. 4 is a side view of the ambulatory surgical gurney showing the controlling means.

Referring to FIG. 4, there is shown a side view of the ambulatory surgical gurney 10 of the present invention with the electronic controlling means 54. The electronic controlling means 54 has a computer 56 with an LCD screen 57. The electronic controlling means 54 also includes a plurality of actuators. FIG. 4 shows the first actuator 58 and the second actuator 60. The computer 56 electronically communicates with the first and second actuators 58 and 60 so as to move the position of the ambulatory surgical gurney 10. The wireless controlling means 62 is in a form of a remote control 64 that has an LCD screen 66 thereon. The electronic controlling means 54 also includes a rechargeable battery 68. The remote control 64 allows medical personnel to instantaneously and efficiently control the position of the ambulatory surgical gurney 10. Information regarding the position of the ambulatory surgical gurney 10 is displayed on the LCD screens 57 and 66.

Figure 5:
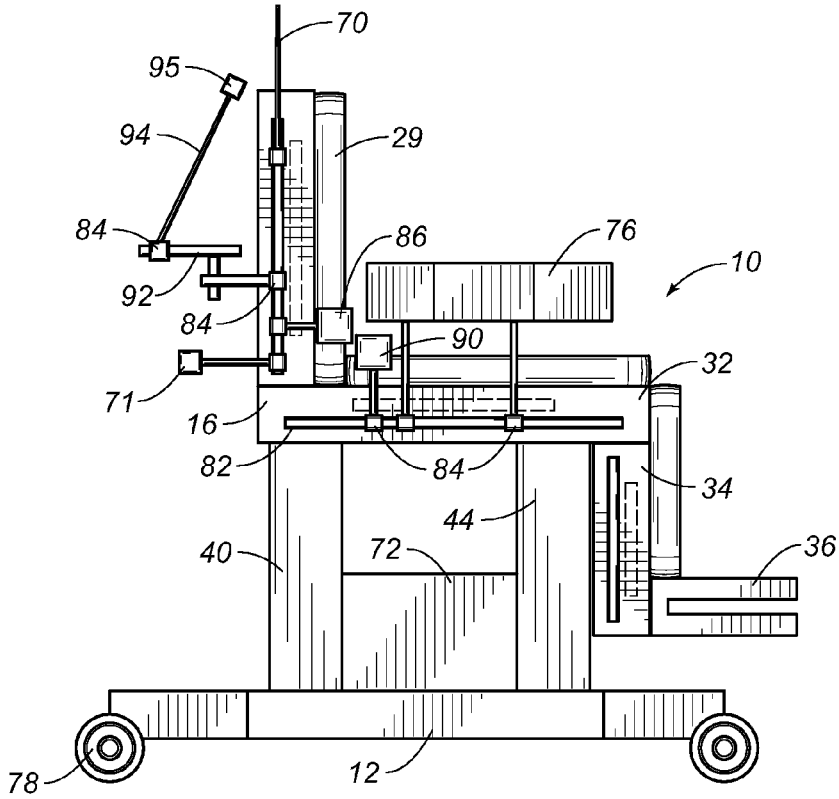
FIG. 5 is a side view of the ambulatory surgical gurney in the chair position with various accessories attached thereto.

Referring to FIG. 5 there is shown a side view of the ambulatory surgical gurney 10 of the present invention in the chair position. As can be seen, the back section 16 is perpendicular to the center section 32. Likewise, the center section 32 is perpendicular to the leg section 34, and the leg section 34 is perpendicular to the foot section 36. In this formation, the plurality of sections provide for a chair with wheels 78. In FIG. 5, the first ram 40 and the second ram 44 are the same height so as to make the center section 32 completely horizontal. However, it is contemplated by the present invention that the first ram 40 and the second ram 44 can be of different heights simultaneously so as to create a reclining chair position. Likewise, the back section 16 does not have to be exactly perpendicular to the center section 32. The back section 16 can be at any angle between perpendicular and horizontal with the center section 32. Similarly, the leg section 34 does not have to be exactly perpendicular with the center section 32. The leg section 34 can be at any angle between perpendicular and horizontal with the center section 32. Similarly still, the foot section 36 can be at any angle between perpendicular and horizontal with the leg section 34.

A number of clamps 84 can be seen attached to the accessory rail 82 of the center section 32 and the back section 16. Attached to one of the clamps 84 of the center section 32 is an arm holder 90. Also attached to the clamps of the center section 32 is a rail 76. The rail 76 is made of plastic. The rail 76 is also extendable for the length of the bed so that the rail can extend the entire length of the bed when the plurality of sections are in the operating room table position.

Attached to one of the clamps 84 of the back section 16 is a handle 71 for the chair. The handle 71 allows medical personnel to push the chair from place to place. A torso holder 86 is attached to another clamp 84 of back section 16. The torso holder 86 helps keep the body of a patient from moving sideways during operation. Also attached to a clamp 84 of the back section 16 is a Mayo stand 92. The Mayo stand 92 is useful for placing any accessory thereon. Attached to the Mayo stand 92 with a clamp 84 is a scope holder 94 holding a scope 95. The scope holder 94 allows a hands-free use of the scope 95 by a surgeon. An IV holder 70 is also shown clamped to the back section 16. The IV holder 70 eliminates completely the need for a separate IV stand that is separately wheeled with the patient.

Figure 6:
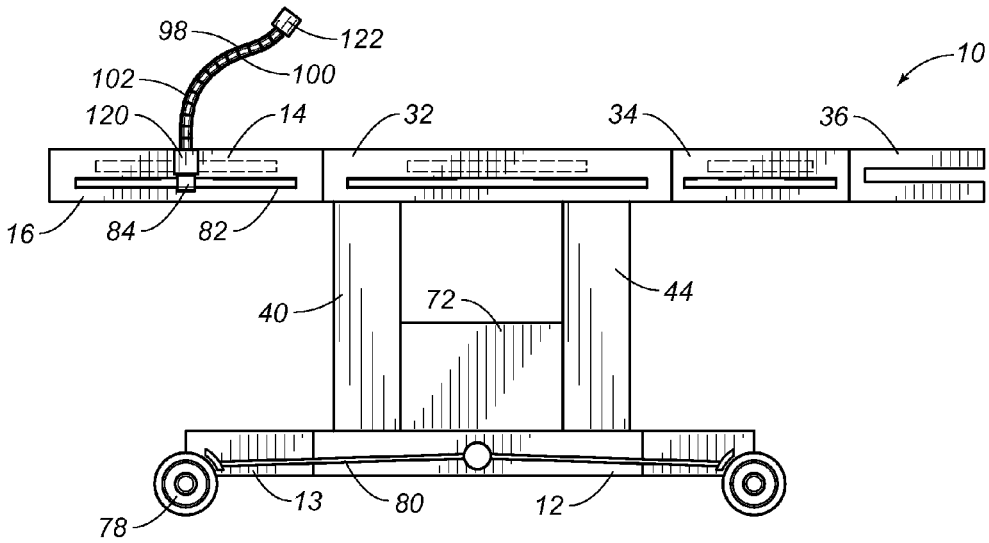
FIG. 6 shows the ambulatory surgical gurney of the present invention in the operating room table position with an anaconda attached thereto and a brake mechanism.

Referring to FIG. 6, there is shown a side view of the ambulatory surgical gurney 10 in the operating room table position with an anaconda 98 attached to the accessory rail 82 by a clamp 84. The anaconda 98 has a plurality of segments 100 attached end-to-end. The top of one segment 102 fits into the bottom of an adjacent segment so that as a whole, the plurality of segments 100 are flexible while staying in a set position. The anaconda 98 has a ratchet spool 120. The ratchet spool 120 tensions a cable in the interior of the anaconda 98 so as to keep the plurality of segments 100 in a fixed position. Attached to the end of the anaconda 98 is any accessory 122 that is adaptable with the plurality of segments 100 of the anaconda 98.

Also shown in FIG. 6 is a brake mechanism 80. The brake mechanism 80 controls the rotation of the wheels 78 of the ambulatory surgical gurney 10. The brake mechanism 80 can make the wheels 78 completely stop from rotating, or the brake mechanism 80 can allow the wheels 78 to rotate but fix the trajectory of a wheel 78. The trajectory of each of the wheels 78 has two possible positions: a locked position and a free position. In the locked position, the wheel 78 cannot spin, but it can rotate. The brake mechanism 80 has the ability to lock the trajectory of two of the four wheels 78 so that the ambulatory surgical gurney 10 can be wheeled from place-to-place. The locking of two wheels allows the ambulatory surgical gurney 10 to be driven like a car where only the front wheels turn to steer.

Figure 7:
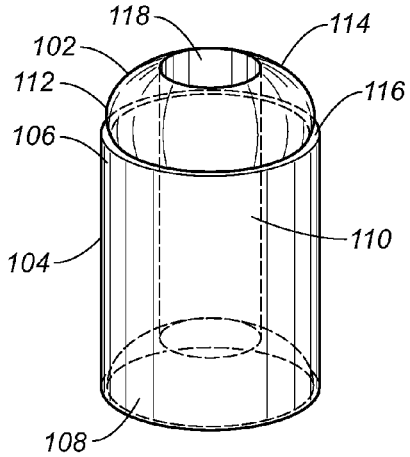
FIG. 7 shows a perspective view of a segment of the anaconda of the present invention.

Referring to FIG. 7, there is shown a perspective view of a segment 102 of the plurality of segments of the anaconda 98. The segment 102 has a cylindrical portion 104 and a rounded member 112. The cylindrical portion 104 has a top 106, a bottom 108, and an interior 110. The rounded member 112 has a top 114, a bottom 116, and an interior 118. The top 106 of the cylindrical portion 104 is adjacent the bottom of the rounded member 112. The interior 110 of the cylindrical portion 104 and the interior of the rounded member 112 are formed so that they create a continuous channel within the segment 102. A tension cable (not shown) extends through this channel so as to be tensionable and fix a position of the segment 102. The bottom 108 of the cylindrical portion 104 is formed so as to accommodate the top 114 of the rounded member 112. In this way, the segment 102 can be connected end-to-end with other segments so as to form the anaconda 98 of the present invention.

Figure 8:
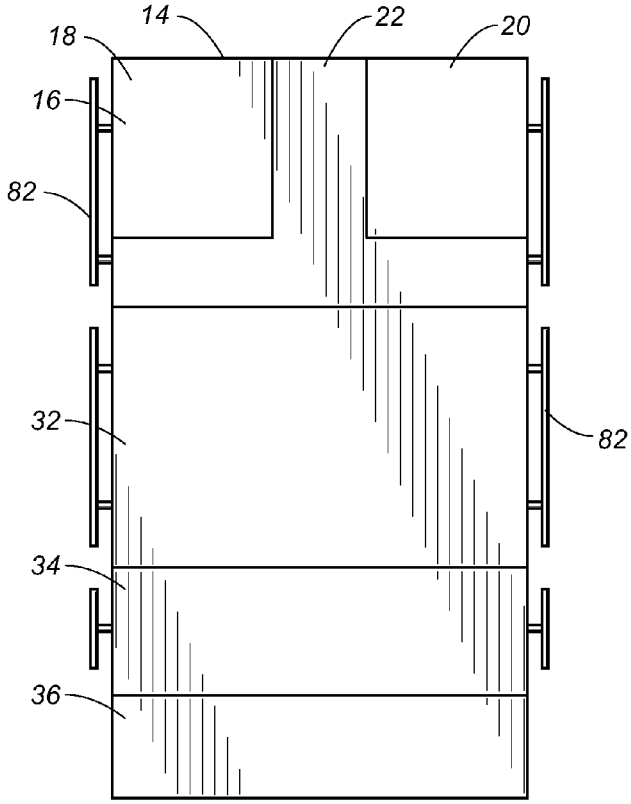
FIG. 8 shows a top view of the sections of the frame of the present invention.

Referring to FIG. 8, there is shown a top view of the plurality of sections of the frame 14 of the present invention. As can be seen, the frame 14 has a back section 16, a center section 32, a leg section 34, and a foot section 36. Accessory rails 82 extend from a side of each of the sections, except for the foot section 36. The foot section 36 has a rack holder 96 instead of an accessory rail 82. The first shoulder portion 18 and the second should portion 20 are both removable from the back section 16 so that only the head portion 22 remains. Removing these portions allows a surgeon to more easily access the shoulders of a patient during arthroscopic surgery.

Figure 9:
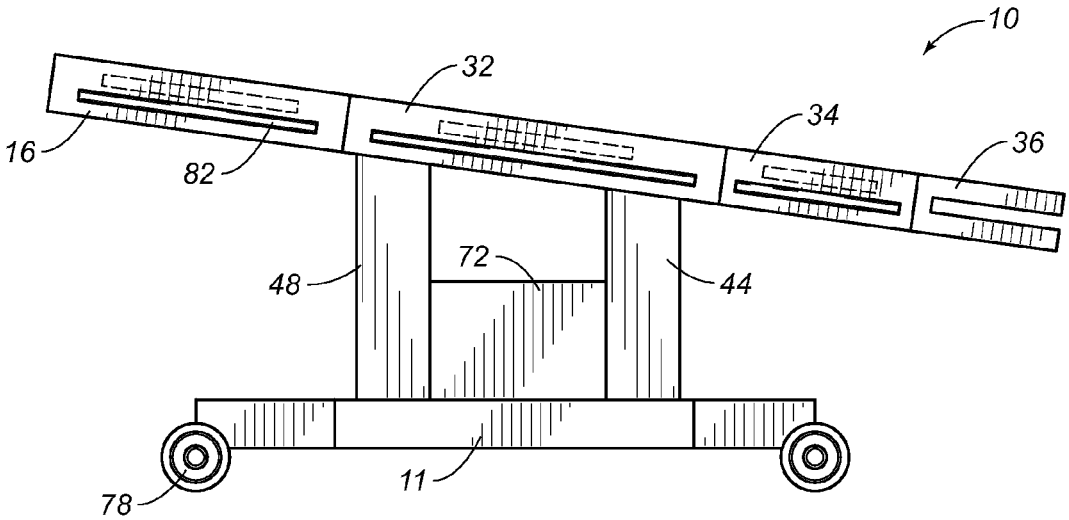
FIG. 9 shows a side view of the ambulatory surgical gurney in the operating room table position with the first ram extending higher than the second ram so that the back section is higher than the foot section.

Referring to FIG. 9, there is shown a side view of the ambulatory surgical gurney 10 of the present invention with the back section 16 vertically higher than the foot section 36. In this position, the first ram 40 extends vertically upwardly more than the second ram 44. The pivotal connections between the first ram 40 and the center section 32 and the second ram 44 and the center section 32 allow the ambulatory surgical gurney 10 to be positioned in this way. The electromechanical lifting means positions the ambulatory surgical gurney 10. Typically, medical personnel will use the wireless remote control (not shown) to position the ambulatory surgical gurney 10.

Figure 10:
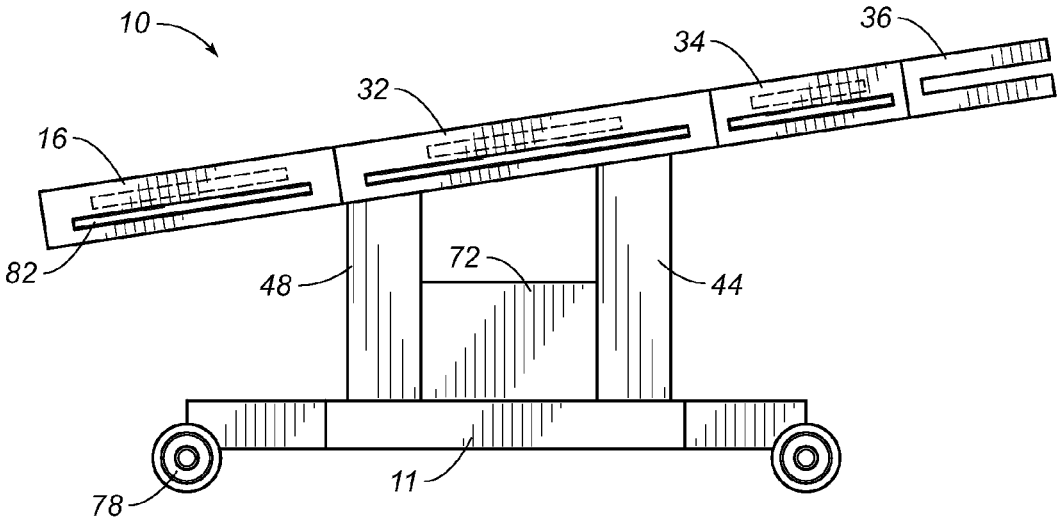
FIG. 10 shows a side view of the ambulatory surgical gurney with the first ram vertically lower than the second ram so that the back section is lower than the foot section.

Referring to FIG. 10, there is shown a side view of the ambulatory surgical gurney 10 of the present invention with the back section 16 vertically lower than the foot section 36. In this position, the first ram 40 extends vertically upwardly for a distance less than the second ram 44. The pivotal connection between the first ram 40 and the center section 32 and between the second ram 44 and the center section 32 allow the ambulatory surgical gurney 10 to be positioned in this way. The electromechanical lifting means (not shown) positions the ambulatory surgical gurney 10. Typically, medical personnel will use the wireless remote control (not shown) to position the ambulatory surgical gurney 10 with the electromechanical lifting means (not shown).

Figure 11:
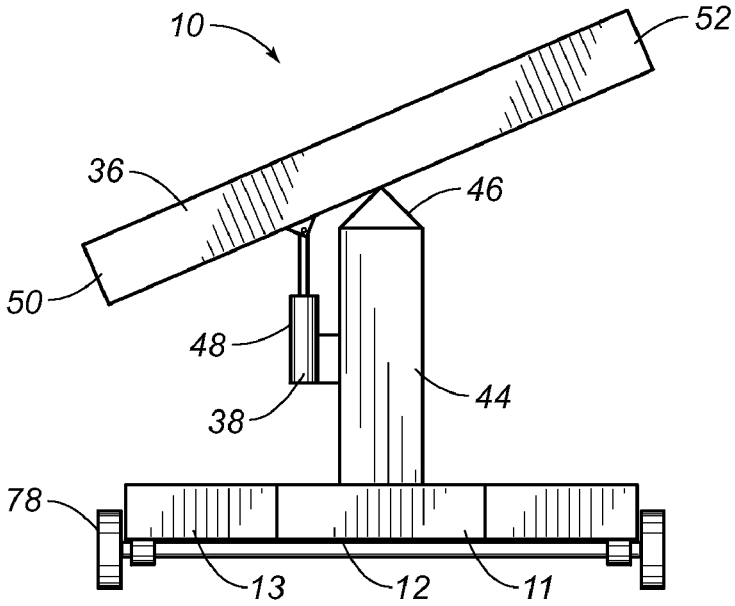
FIG. 11 shows an end view of the ambulatory surgical gurney with the lift arm in a first position where the first side is lower than the second side.

Referring to FIG. 11, there is shown an end view of the ambulatory surgical gurney 10 of the present invention with the electromechanical lifting means 38 positioning the first side 50 of the ambulatory surgical gurney 10 lower than the second side 52. The lift arm 48 of the electromechanical lifting means 38 is shown in the retracted position so that the first side 50 can be lower that the second side 52. The lift arm 42 is connected to the first ram 40 (not shown). The second ram 44 is pivotally connected to the center section (not shown) at its upper end 46. Because FIG. 11 shows the ambulatory surgical gurney 10 from an end view, only the foot section 36 of the plurality of sections can be seen.

Figure 12:
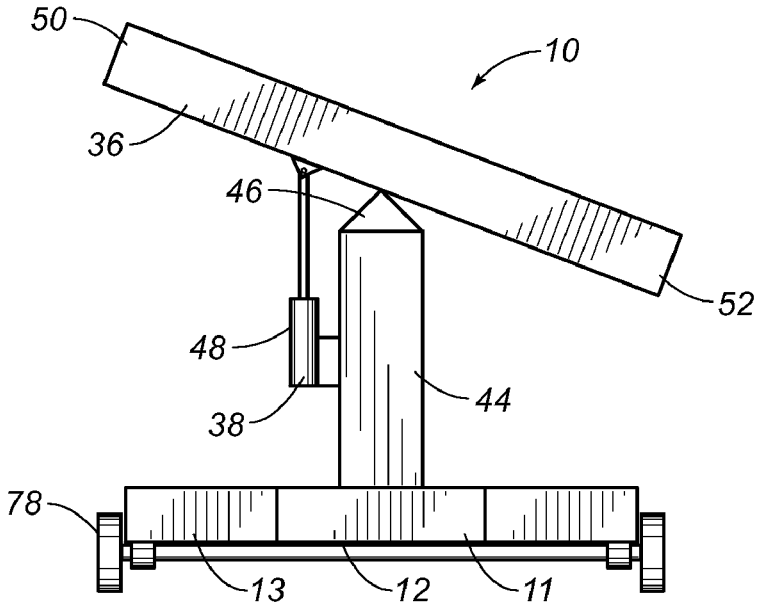
FIG. 12 shows the ambulatory surgical gurney with the lift arm in a second position where the first side is higher than the second side.

Referring to FIG. 12, there is shown an end view of the ambulatory surgical gurney 10 with the first side 50 positioned higher than the second side 52. The lift arm 48 of the electromechanical lifting means 38 is in the extended position, thus allowing the first side 50 to be positioned higher than the second side 52. The lift arm 48, the upper end 46 of the second ram 44, and the upper end (not shown) of the first ram (not shown) are pivotally connected to the center section 32 (not shown) of the plurality of sections.

Figure 13:
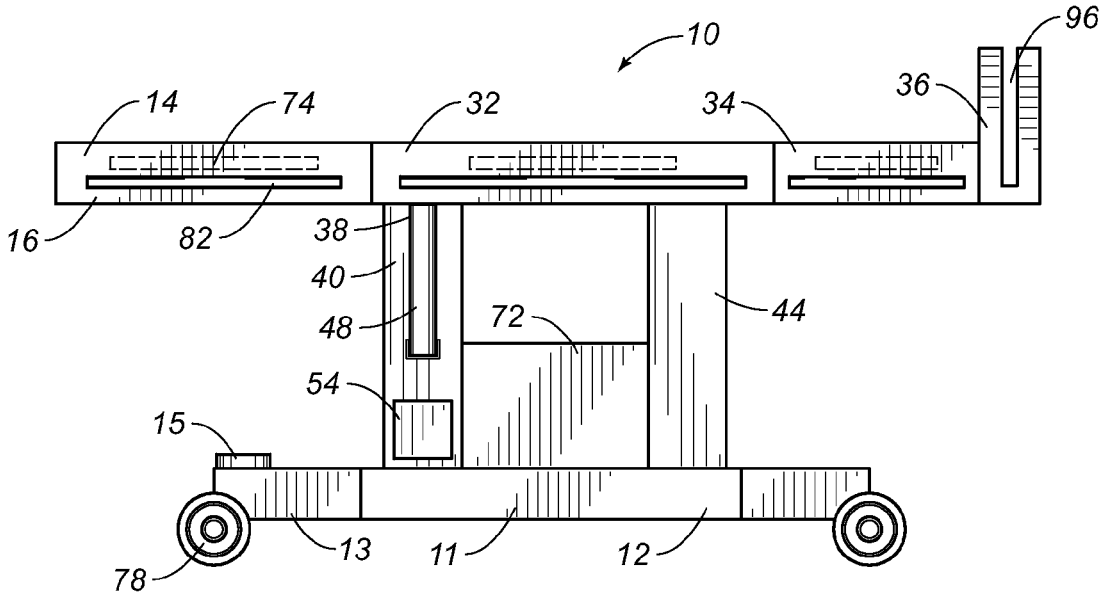
FIG. 13 shows the ambulatory surgical gurney of the present invention in the gurney position.

Referring to FIG. 13, there is shown a side view of the ambulatory surgical gurney 10 of the present invention in the gurney position. In this position, the foot section 36 is positioned perpendicular to the leg section 34, while the leg section 34, the center section 32, and the back section 16 are all positioned horizontal relative to each other. As shown, the plurality of sections are in the horizontal position as viewed from side-to-side, but the present invention contemplates that the lift arm 48 of the electromechanical lifting means 38 can position the plurality of sections at any side-to-side angle.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a base;

a frame positioned above said base, said frame having a plurality of sections pivotally connected together;

a lifting means positioned between said frame and said base, said lifting means for adjusting a distance of said frame above said base, said lifting means for adjusting a longitudinal angle and a lateral angle of said frame relative to said base, said lifting means comprising:

a first ram extending vertically between said base and said frame;

a second ram extending vertically between said base and said frame, said first ram being in spaced relationship to said second ram, said frame being pivotally connected to an upper end of said first and second rams, said first and second rams being selectively extendable and retractable so as fix the longitudinal angles of said frame relative to said base;

a lift arm having an upper end pivotally connected to said frame, said lift arm being selectively extendable and retractable so as to controllably fix the lateral angle of said frame relative to said base, said lift arm affixed to a side of one of said first and second rams and extending in parallel relation therewith; and a controlling means cooperative with said first and second rams and with said lift arm for controlling a movement of the first and second rams and said lift arm.

2. The apparatus of claim 1, said base comprising:

a central portion;

a plurality of foot portions extending outwardly from said central portion; and a tank holder formed in one of said plurality of foot portions.

3. The apparatus of claim 1, said plurality of sections comprising:

a back section;

a center section pivotally connected to said back section such that said back section is movable between a first position coplanar with said center section and a second position approximately perpendicular upwardly relative to said center section, said center section pivotally connected to said upper end of said first ram and to said upper end of said second ram and to said lift arm;

a leg section pivotally connected to said center section; and a foot section pivotally connected to said leg section, said foot section being movable between a first position coplanar with said leg section and a second position approximately perpendicular relative to said leg section.

4. The apparatus of claim 3, further comprising:

a torso holder removably attached to said back section;

a leg holder removably attached to said leg section;

an arm holder removably attached to said center section;

a Mayo stand removably mounted to a back of said back section;

a scope holder removably attached to said Mayo stand; and a chart rack holder mounted to an end of said frame opposite said back section.

5. An apparatus comprising:

a base;

a frame positioned above said base, said frame having a plurality of sections pivotally connected together, one of said plurality of sections being a back section, said back section comprising:

a first shoulder portion;

a second shoulder portion; and a head portion positioned between said first shoulder portion and said second shoulder portion, said head portion having a head holder, said head holder being movable in two dimensions, said head holder comprising:

a forehead strap having ends removably connected to said head portion;

a chin strap connected to said forehead strap and extending downwardly therefrom; and an eye cover connected to said forehead strap; and a lifting means positioned between said frame and said base, said lifting means for adjusting a distance of said frame above said base, said lifting means for adjusting a longitudinal angle and a lateral angle of said frame relative to said base, said lifting means comprising:

a first ram extending vertically between said base and said frame;

a second ram extending vertically between said base and said frame, said first ram being in spaced relationship to said second ram, said frame being pivotally connected to an upper end of said first and second rams;

a lift arm pivotally connected to said frame, said lift arm being extendable and retractable so as to controllably move said frame from side-to-side; and a controlling means cooperative for controlling a movement of said first and second rams and said lift arm.

6. The apparatus of claim 5, said first shoulder portion being removable from said back section, said second shoulder portion being removable from said back section.

7. The apparatus of claim 5, said plurality of sections being movable among a first position in an operating table configuration and a second position in a chair configuration and a third position in a gurney configuration.

8. The apparatus of claim 5, said controlling means comprising:

a computer mounted to said base;

a plurality of actuators electrically connected to said computer;

a wireless controlling means for wirelessly controlling said first and second rams and said lift arm, said wireless controlling means having an LCD screen; and a battery electrically connected to said computer and to said plurality of actuators.

9. The apparatus of claim 5, further comprising:

an IV holder removably attached to said frame;

a locker positioned on said base between said first and second rams;

a plurality of X-ray cassettes removably positioned in said frame;

at least one rail removably mounted to a side of said frame, said rail being expandable for a length equal to a length of said frame;

a plurality of wheels mounted to each of said plurality of foot portions;

a brake mechanism for controlling a movement of each of said plurality of wheels from a first position to a second position; and an accessory rail mounted to a side of said frame, said accessory rail having a plurality of clamps suitable for mounting accessories thereto.

10. The apparatus of claim 9, said frame and said base and said at least one rail being formed of polymeric material.

11. The apparatus of claim 5, further comprising:

an anaconda removably mounted to said frame, said anaconda comprising:

a plurality of segments connected end-to-end so as to form a flexible tube; and a ratchet spool connected to an end of a first segment of said plurality of segments.

12. The apparatus of claim 11, each of said plurality of segments having a body comprising:

a cylindrical portion having a hollow interior and a top and a bottom; and a rounded member having a hollow interior and a top and a bottom, said bottom of said rounded member being attached to said top of said cylindrical portion, said hollow interiors of said rounded member and said cylindrical portion forming a continuous cylindrical channel within said body, said bottom of said cylindrical portion being formed so as to accommodate said top of said rounded member.

13. An apparatus comprising:

a base;

a frame positioned above said base, said frame having a plurality of sections pivotally connected together;

a lifting means positioned between said frame and said base, said lifting means for adjusting a distance and an angle of said frame above said base, said lifting means comprising:

a first ram extending vertically between said base and said frame;

a second ram extending vertically between said base and said frame, said first ram being in spaced relationship to said second ram, said frame being pivotally connected to an upper end of said first and second rams;

a lift arm pivotally connected to said frame, said lift arm being extendable and retractable so as to controllably move said frame from side-to-side; and a controlling means for controlling a movement of said first and second rams and for controlling a movement of said lift arm;

an anaconda removably mounted to said frame, said anaconda comprising:

a plurality of segments connected end-to-end so as to form a flexible tube; and a ratchet spool connected to an end of a first segment of said plurality of segments, said plurality of sections being movable among a first position in an operating table configuration and a second position in a chair configuration and a third position in a gurney configuration, said plurality of sections of said frame comprising:

a back section;

a center section pivotally connected to said back section such that said back section is movable between a first position coplanar with said center section and a second position approximately perpendicular upwardly relative to said center section, said center section pivotally connected to said upper end of said first ram and to said upper end of said second ram and to said lift arm;

a leg section pivotally connected to said center section; and a foot section pivotally connected to said leg section, said foot section being movable between a first position coplanar with said leg section and a second position approximately perpendicular relative to said leg section, said back section comprising:

a first shoulder portion removable from said back section;

a second shoulder portion removable from said back section; and a head portion located between said first portion and said second portion, said head portion being movable in two dimensions, said head portion having a head holder comprising:

a forehead strap having ends removably connected to said head portion;

a chin strap connected to said forehead strap; and an eye cover connected to said forehead strap, said base comprising:

a central portion;

a plurality of foot portions extending outwardly from said base;

a tank holder formed in one of said plurality of foot portions, said electronic controlling means comprising:

a computer mounted to said base;

a plurality of actuators electrically connected to said computer;

a wireless controlling means for wirelessly controlling said first and second rams and said lift arm, said wireless controlling means having an LCD screen; and a battery electrically connected to said computer and to said plurality of actuators;

an IV holder removably attached to said frame;

a locker positioned on said base between said first and second rams;

a plurality of X-ray cassettes removably positioned in said frame;

at least one rail removably mounted to a side of said frame, said rail being expandable for a length equal to a length of said frame;

a plurality of wheels mounted to each of said plurality of foot portions;

a brake mechanism for controlling a movement of each of said plurality of wheels from a first position to a second position;

an accessory rail mounted to a side of said frame, said accessory rail having a plurality of clamps for mounting accessories thereto;

a torso holder removably attached to said back section;

a leg holder removably attached to said leg section;

an arm holder removably attached to said center section;

a Mayo stand removably mounted to a back of said back section;

a scope holder removably attached to said Mayo stand; and a chart rack holder mounted to an end of said frame opposite said back section, each of said plurality of segments of said anaconda having a body comprising:

a cylindrical portion having a hollow interior and a top and a bottom; and a rounded member having a hollow interior and a top and a bottom, said bottom of said rounded member being attached to said top of said cylindrical portion, said hollow interiors of said rounded member and said cylindrical portion forming a continuous cylindrical channel within said body, said bottom of said cylindrical portion being formed so as to accommodate said top of said rounded member, said frame and said base and said at least one rail being formed of a polymeric material.

* * * * *